United States Patent [19]

Nakagoshi

[11] Patent Number: 5,020,669

[45] Date of Patent: Jun. 4, 1991

[54] PHOTOGRAPHIC FILM PACKAGE

[75] Inventor: Isao Nakagoshi, Kanagawa, Japan

[73] Assignee: Fuji Photo Film Co., Ltd., Minami-Ashigara, Japan

[21] Appl. No.: 563,666

[22] Filed: Aug. 3, 1990

Related U.S. Application Data

[63] Continuation of Ser. No. 414,310, Sep. 29, 1989, abandoned.

[30] Foreign Application Priority Data

Oct. 17, 1988 [JP] Japan ..... 63-134470[U]

[51] Int. Cl.[5] ..... B65D 73/00

[52] U.S. Cl. ..... 206/466; 206/461; 206/497; 206/459; 206/45.33

[58] Field of Search ..... 206/45.18, 45.23, 45.24, 206/461, 464, 466, 470, 471, 497, 601, 459, 45.33, 45.31

[56] References Cited

U.S. PATENT DOCUMENTS

| | | | |
|---|---|---|---|
| 1,940,078 | 12/1933 | Cooper | 206/466 |
| 3,093,244 | 6/1963 | Middleton, Jr. et al. | 206/45.24 |
| 3,215,267 | 11/1965 | Potter . | |
| 3,480,138 | 11/1969 | Baker | 206/461 |
| 3,540,583 | 11/1970 | Tomlinson | 206/497 |
| 3,764,002 | 10/1973 | Spiegel et al. | 206/471 |
| 3,844,409 | 10/1974 | Bodolay et al. | 206/466 |
| 3,885,667 | 5/1975 | Spiegel et al. | 206/466 |
| 3,891,090 | 6/1975 | Spiegel et al. | 206/497 |
| 4,166,532 | 9/1979 | Tsuchida et al. | 206/497 |
| 4,205,750 | 6/1980 | Dews | 206/497 |
| 4,307,804 | 12/1981 | Berham | 206/497 |
| 4,619,364 | 10/1986 | Czopor, Jr. | 206/470 |
| 4,630,434 | 12/1986 | Severin et al. | 206/461 |
| 4,702,368 | 10/1987 | Jones | 206/461 |
| 4,807,747 | 2/1989 | Hadtke | 206/470 |

FOREIGN PATENT DOCUMENTS

| | | |
|---|---|---|
| 0082458 | 6/1983 | European Pat. Off. . |
| 2589130 | 4/1987 | France . |
| 52-14903 | 4/1977 | Japan . |
| 62-76161 | 5/1987 | Japan . |
| 63-79385 | 5/1988 | Japan . |
| 1081927 | 9/1967 | United Kingdom . |

*Primary Examiner*—David T. Fidei

*Attorney, Agent, or Firm*—Burns, Doane, Swecker & Mathis

[57] ABSTRACT

A photographic film package which comprises a header paper mount formed in a L-shape so as to have a placing part, photographic film(s) placed on said placing part, and a shrinked film wrapping the photographic films and the paper mount integrally. Since the photographic film(s) are wrapped integrally with the placing part of the header paper mount by the shrinkable film, the photographic film(s) can be holded for a long period.

2 Claims, 2 Drawing Sheets

PHOTOGRAPHIC FILM PACKAGE

This application is a continuation, of application Ser. No. 414,310, Aug. 29, 1989 now abandoned.

BACKGROUND OF THE INVENTION

1. Field of the Invention

This invention relates to a photographic film package where photographic film (s) placed in an unitary packaging box are wrapped by a shrinkable film.

2. Description of the Prior Art

A light-shielding cartridge containing a photographic film therein is put in a cartridge case, and the cartridge case is placed in an unitary packaging box. Photographic film is sold in each unitary packaging box, or several unitary packaging boxes and wrapped by a cellophane film, placed in a bag together with a premium or wrapped with a shrinkable film and placed in a box with a header.

However, when the unitary packaging boxes are sold in a shape placed in a box with a header, the material cost and the manufacturing cost of the box are great, and the packaging work is troublesome.

In the dry battery field, it is known to package several dry batteries integrally by a shrinkable film without using a box. That is, several dry batteries are arranged on a flat paper mount, and wrapped integrally by a shrinkable film together with the paper mount (Japanese Utility Model KOKOKU No. 52-14903 and Japanese Utility Model KOKAI Nos. 62-76161 and 63-79385). In the above package, the dry batteries are supported by the shrinked film alone. Therefore, when they were displayed in a hung state, they occasionally dropped out from the opening of the shrinked film by the gradual weakening of the stretching force of the shrinked film.

SUMMARY OF THE INVENTION

An object of the invention is to provide a photographic film package excellent in holdability of the photographic films and inexpensiveness.

The inventor has investigated in order to achieve such an object. When the aforementioned package for dry batteries was applied to a photographic film package, the holdability of the shrinked film was insufficient, and the gradual weakening of the stretching force was a problem. In the package of the invention, an L-shaped paper mount is incorporated, and photographic films are held by a part of the paper mount and the shrinked film.

Thus, the photographic film package of the invention comprises a header paper mount formed in a L-shape so as to have a placing part, photographic film (s) placed on said placing part, and a shrinked film wrapping the photographic films and the paper mount integrally.

DETAILED DESCRIPTION OF THE INVENTION

The header paper mount is formed of one sheet of paper, and the thickness is about 0.4 mm. The paper mount is formed in a L-shape, and the folded portion is used as the placing part for the photographic film (s). The size of the paper mount may be enough to hold the photographic film (s) together with the shrinked film, and for example, the width may be equal to or narrower than the photographic film. In order to increase the holdability of the photographic film (s), it is preferable that at least one side edge of the paper mount is provided with an engaging recess such as an notch for the shrinkable film around the upper edge of the photographic film (s).

The shrinkable film is polyvinyl chloride film, polyethylene film or the like, and may be printed for decoration or other purposes. Perforation line (s) may be provided on the rear side of the shrinked film in order to facilitate opening. When some kinds of the photographic film packages are made, a bar code corresponding to each kind may be printed in order to discriminate them.

The photographic film may be any shape placed in a light-shielding cartridge, further placed in a cartridge case, still further placed in an unitary packaging box or the like. The number of the photographic films in the package is preferably 1 to 6.

An advertising plate printed with a particular design may be disposed on the front side of the photographic films or other places. The advertising plate improves the display effect as well as protects the photographic films.

In the photographic film package of the invention, labor and materials can be saved, and the manufacturing cost is decreased. Since the photographic film (s) are wrapped integrally with the placing part of the header paper mount by the shrinkable film, the photographic film (s) can be held for a long period.

EXAMPLES

Figure 1:
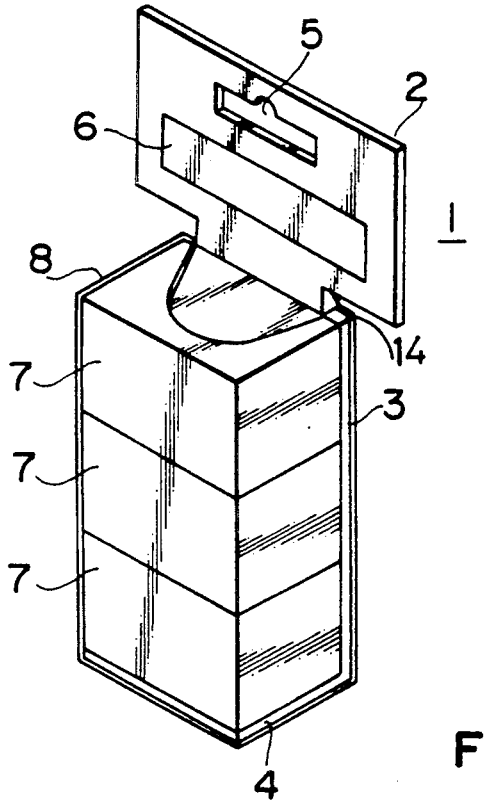
FIG. 1 is a perspective view of a photographic film package embodying the invention.
Figure 2:
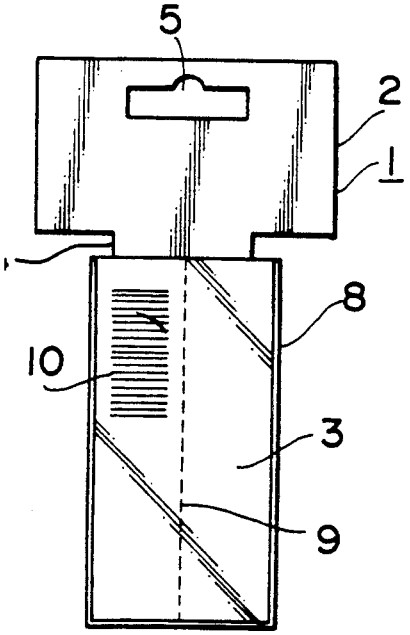
FIG. 2 is a rear view.
Figure 3:
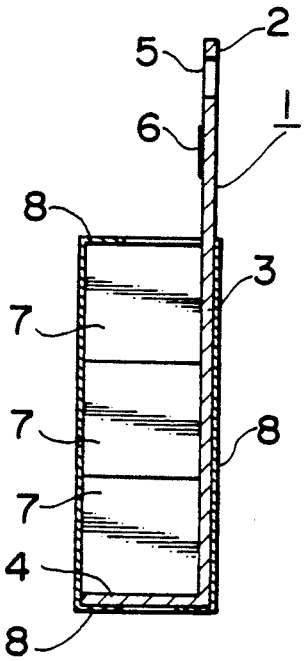
FIG. 3 is a sectional view, thereof.

An example of the photographic film package of the invention is illustrated in FIGS. 1 to 3. The header paper mount 1 is made of a cardboard 0.36 mm in thickness, and composed of the upper wide part of a display board portion 2, the middle part of a backplate portion 3 and the folded part of the placing part 4 folded in a right angle. The display board portion 2 is provided with a hanging hole 5 located on the upper part and a display part 6 for indicating the name of a retail store, a photograph, a mark or the like. A square notch 14 is cut on the boundary between the display board portion 2 and the backplate portion 3 on both side edges of the paper mount. Three unitary packaging boxes 7 containing a photographic film are stacked on the placing part 4, and the photographic film unitary packaging boxes 7 are wrapped by the shrinkage film 8 made of polyvinyl chloride together with the placing part 4 and the backplate part 3 of the header paper mount 1. The upper part of the shrinked film 4 is engaged with the notches 14. As shown in FIG. 2, a perforation line 9 for opening is formed at the center of the rear side of the shrinked film 8 in the vertical direction, and the rear side is printed with a bar code for POS system.

The above photographic film package is made by stacking the photographic film unitary packaging boxes 7 on the header paper mount 1, inserting the stacked one into a tube of the shrinkable film 8 cut into a prescribed length, and then heating to shrink the shrinkable film. The photographic film packages of FIG. 1 are displayed by hanging the hanging hole 5 on a hook of a display stand or other arrangement of them on a display stand.

Figure 4:
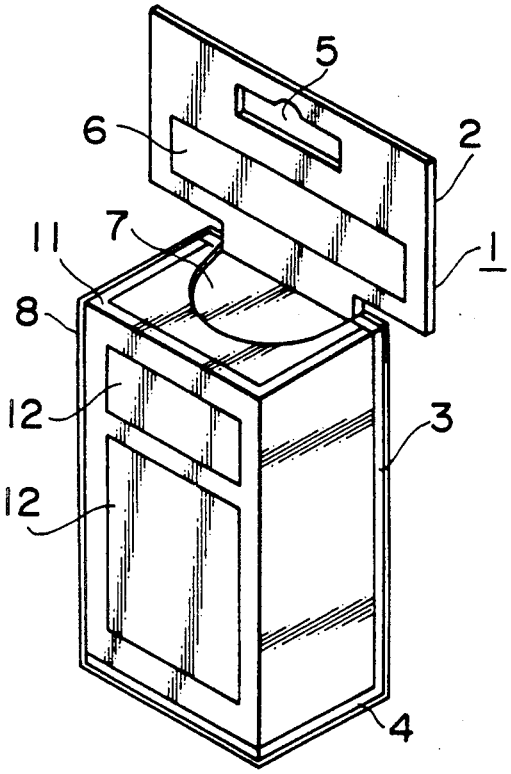
FIG. 4 is a perspective view of another example of the photographic film package of the invention.

Another example of the photographic film package of the invention is illustrated in FIG. 4. This photographic film package is the same as that shown in FIGS. 1 to 3, except that an advertising plate 11 is further incorporated. The advertising plate 11 is channel-shaped or U-shaped, and covers the front and both sides of the stacked photographic film unitary packaging boxes. A particular design is printed on the advertising plate 11 as an advertising displate part 12. The advertising plate 11 is wrapped by the shrinkable film 8 together with the photographic film unitary packaging boxes 7 and the placing part 4 and the backplate part 3 of the header paper mount 1.

Figure 5:
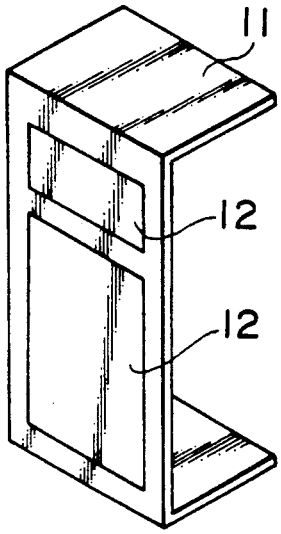
FIG. 5 and FIG. 6 are perspective views of advertising plate examples.

Another advertising plate 11 is shown in FIG. 5. The advertising plate 11 is also channel-shaped or U-shaped, and it covers the front, upside and bottom of the stacked photographic film unitary packaging boxes.

Figure 6:
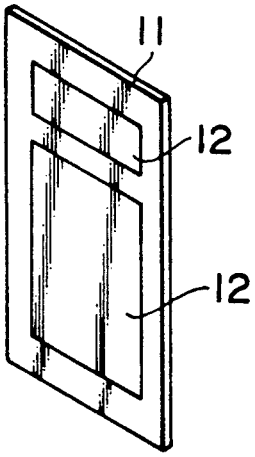

Still another advertising plate 11 is shown in FIG. 6. The advertising plate 11 is flat, and provided on the front of the stacked photographic film unitary packaging boxes.

Figure 7:
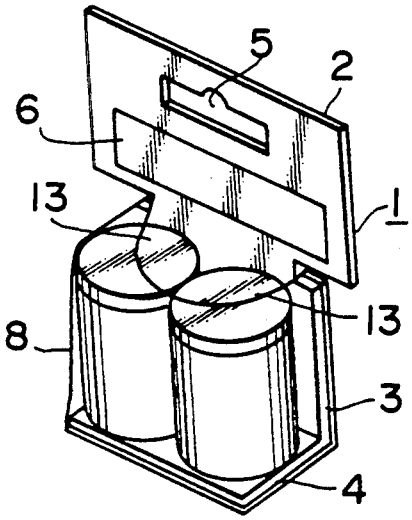
FIG. 7 is a perspective view of still another example of the photographic film package of the invention.

Another example of the photographic film package of the invention is illustrated in FIG. 7. Two cartridge cases 13 containing a photographic film are placed on the placing part 4 of the header paper mount 1, and wrapped by a shrinkable film 8. The surface of each cartridge case 13 is printed with an advertising design or attached with a printed label.

As described before, the placing part of this invention reduces the manufacturing cost by saving labor and materials.

Moreover, the packaging speed of this photographic film package is highly acceralated and packaging accuracy is particularly improved by applying the placing part. Therefore, the packaging machine for the photographic film package of this invention may be of comparatively simple structure, without any adapter for getting packaging speed and packaging accuracy.

I claim:

1. A photographic film package consisting essentially of a header paper mount formed in a L-shape so as to have a back plate with a transversely extending placing part, at least one photographic film placed on said placing part, and a shrinked film integrally wrapping said at least one photographic film and the paper mount, at least one side edge of the paper mount provided with an engaging recess for the shrinked film around an upper edge of the photographic film and a perforation line provided in the shrinked film along a rear side of the package, further including a substantially U-shaped plate adapted to receive advertising indicia, said plate consisting of a first panel having two transversely extending end panels overlying opposite sides of said photographic film.

2. The photographic film package of claim 1 wherein said at least one photographic film is stacked parallel to said placing part.

* * * * *